United States Patent [19]

Levchenko et al.

[11] Patent Number: 4,517,883

[45] Date of Patent: May 21, 1985

[54] AIR EXTRACT METHOD AND APPARATUS

[75] Inventors: Alec Levchenko, Bolton; Michael R. Booth, Timperley, both of England

[73] Assignee: Febopal Limited, Bolton, England

[21] Appl. No.: 469,703

[22] Filed: Feb. 25, 1983

[30] Foreign Application Priority Data

| | | | |
|---|---|---|---|
| Apr. 16, 1981 | [GB] | United Kingdom | 8112155 |
| Mar. 24, 1982 | [GB] | United Kingdom | 8208602 |
| Apr. 16, 1982 | [JP] | Japan | 57-63782 |

[51] Int. Cl.[3] ..... F23J 11/00

[52] U.S. Cl. ..... 98/115.3

[58] Field of Search ..... 98/39, 115 R, 115 LH; 126/299 R, 299 D

[56] References Cited

U.S. PATENT DOCUMENTS

| | | | |
|---|---|---|---|
| 2,422,330 | 6/1947 | Allerdice | 98/115 R X |
| 3,766,906 | 10/1973 | Jenn | 126/299 R |
| 3,800,689 | 4/1974 | Brown | 126/299 D |
| 3,850,086 | 11/1974 | Walters et al. | 98/115 LH |
| 4,150,606 | 4/1979 | Nelson | 98/115 LH |
| 4,160,407 | 7/1979 | Duym | 98/115 R |
| 4,352,349 | 10/1982 | Yoito | 126/299 R |

*Primary Examiner*—Harold Joyce

*Attorney, Agent, or Firm*—Frost & Jacobs

[57] ABSTRACT

An air extract method and apparatus particularly for use with fume cupboards. The interior of the fume cupboard is connected to a suction fan via ducting and in the ducting is provided a connection to the outside atmosphere controlled by a baffle. The baffle position reduces the flow of air from the fume cupboard as it increases the flow from outside and vice versa, the position of the baffle being controlled by a servo motor or pneumatic cylinder operated by means responsive to the position of the sash window on the fume cupboard. Raising the sash window increases the air flow from the fume cupboard as it reduces the flow from outside, so that the velocity of air fow through the window aperture is always above a minimum and the exhaust velocity from the fan is also maintained.

6 Claims, 9 Drawing Figures

10
9

19
11
14
13
12
1
17
8
2
6
23
7
5
4
2
3

14
13
13''
17
18
19
IV
IV
16
13'
12
8
15

19
13'
17
18

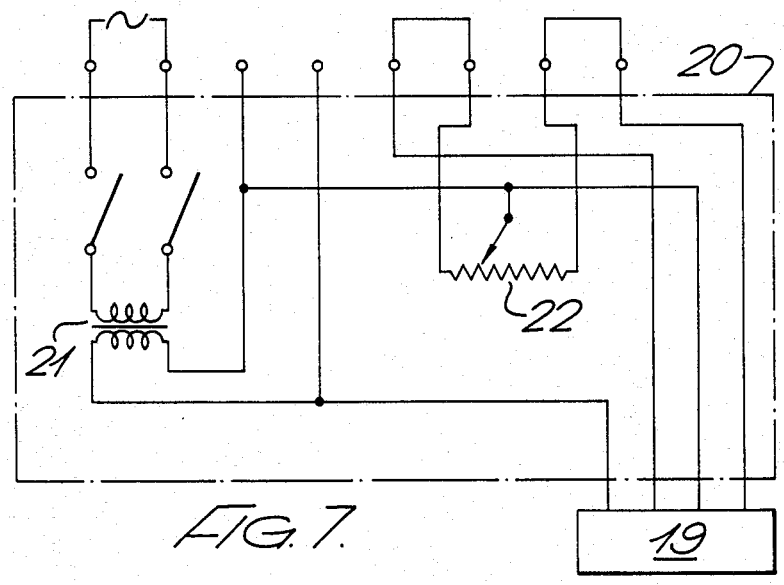
FIG. 7.
FIG. 8.
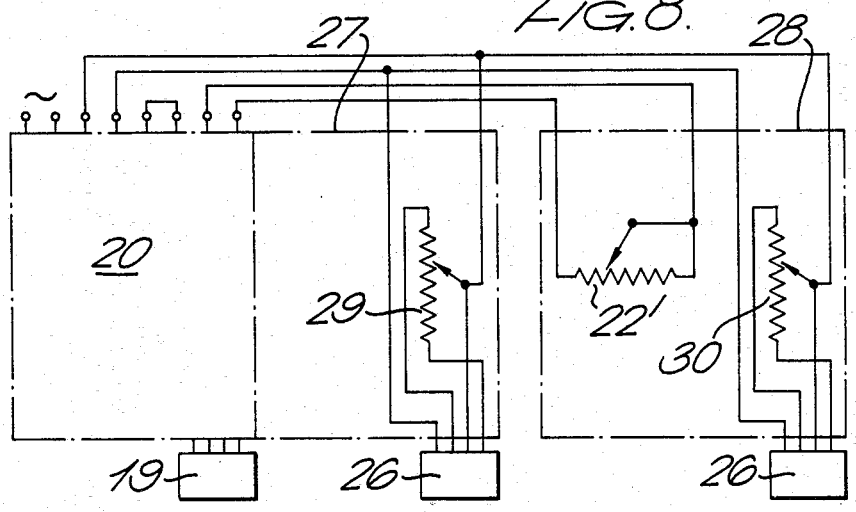

AIR EXTRACT METHOD AND APPARATUS

The present invention relates to an air extract method and apparatus in which air is drawn out of an enclosure by a suction fan, particularly for maintaining a minimum velocity of air flow between a room and an enclosure opening into the room in which the area of the opening between the room and the enclosure is variable.

There are various situations where an enclosure opens into a room for access to the interior of the enclosure but where it is necessary to prevent vapous or gases from the enclosure entering the room. In particular, fume cupboards in which dangerous procedures are carried out must be accessible from the laboratory and for this reason have a sliding sash which closes over the opening between the laboratory and the interior of the fume cupboard. Safety standards require that the air in the fume cupboard with its entrained fumes or gases is extracted in a manner so as to cause fresh air to enter the fume cupboard from the laboratory at a velocity high enough to prevent the fumes or gases escaping into the laboratory.

The latest draft British Standard requires that the velocity of the air into the fume cupboard be at least 0.5 m per second. In order to achieve this minimum velocity of air when the sliding sash is fully open on a typical fume cupboard having an opening of 1.5 m by 1 m the extract apparatus must remove at least 0.75 m per second of air from the laboratory. This in a considerable volume of air and the extracted air is heated on air conditioned air which since it is exhausted to the outside atmosphere must be replaced by the heating or air conditioning plant. Also in order to achieve adequate dispersal of the dangerous fumes into the atmosphere the exhaust velocity of the extracted air must be kept at a high level. This results in conventional air extract systems having the volume of air extracted per second constant at the value required when the sash is fully opened, so that lowering the sash merely increases the air velocity through the aperture and does not save any of the heated or air conditioned air from being lost.

It has been suggested to provide a controlled source of bypass air from outside the room in which the fume cupboard stands so that less heated or air conditioned air is lost when the sash is lowered.

According to one aspect of the present invention we provide an air extract method in which a suction fan draws air out of an enclosure and bypass air from outside the enclosure, wherein adjustable baffle means is arranged to increase the volume of bypass air passing through the fan from the outside atmosphere as it reduces the volume of air passing through the fan from the enclosure and vice versa.

In this method the volume of air extracted from the enclosure and the volume of the bypass air are directly related and controlled so that the exhaust velocity can be readily maintained while the volume of air extracted is varied.

Advantageously, the enclosure opens into a room, the area of the opening between the room and the enclosure being variable, the bypass air is drawn from the atmosphere outside the room, and the baffle means is controlled by control means responsive to the area of the opening so as to maintain a minimum velocity of air flow between the room and the enclosure.

This allows the minimum velocity of air flow to be maintained automatically when the opening is varied in area, by changing the volume of air drawn from the room in a manner which can also maintain the exhaust velocity.

Preferably, the baffle means increases the volume of air passing through the fan per second from the enclosure proportionately as the area of the opening increases so as to give a substantially constant velocity of air flow between the room and the enclosure.

According to another aspect of the present invention we provide air extract apparatus for drawing air out of an enclosure, comprising a suction fan connected at its suction side to draw air from the interior of the enclosure and to draw bypass air from the atmosphere outside the enclosure, wherein there is disposed between the suction fan and both the enclosure and the outside atmosphere adjustable baffle means operable to increase the volume of bypass air passing through the fan from the outside atmosphere as it reduces the volume of air passing through the fan from the enclosure and vice versa.

This apparatus enables the air flow from the enclosure and the outside atmosphere to be each directly controlled so as to maintain the required fan exhaust velocity while varying the volume of air extracted from the enclosure.

An air exhaust method and apparatus according to the present invention will now be described by way of example and with reference to the accompanying drawings in which:

FIG. 7 is a wiring diagram of the control circuit for the installation of FIG. 1;

FIG. 8 is a modification of the wiring diagram of FIG. 7 for use with a pair of fume cupboards.

Figure 1:
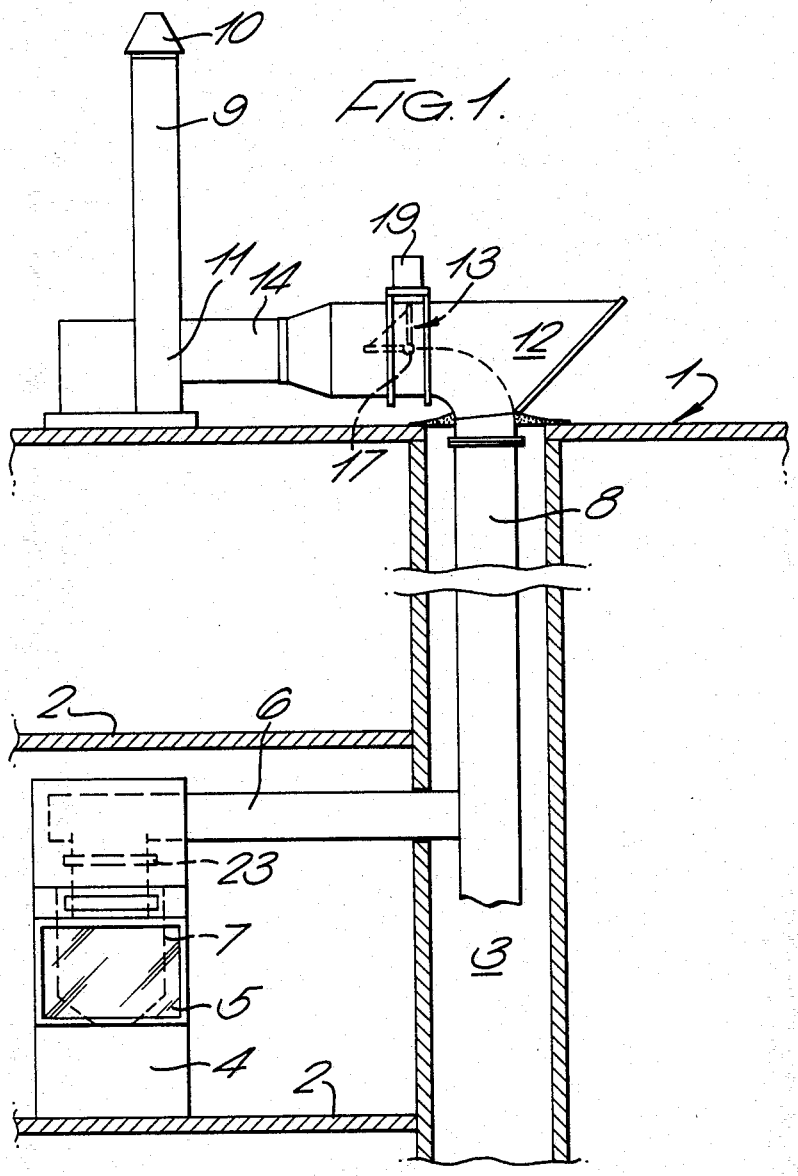
FIG. 1 is a diagrammatic sectional elevation of an air exhaust installation incorporating the present invention.
Figures 2, 4:
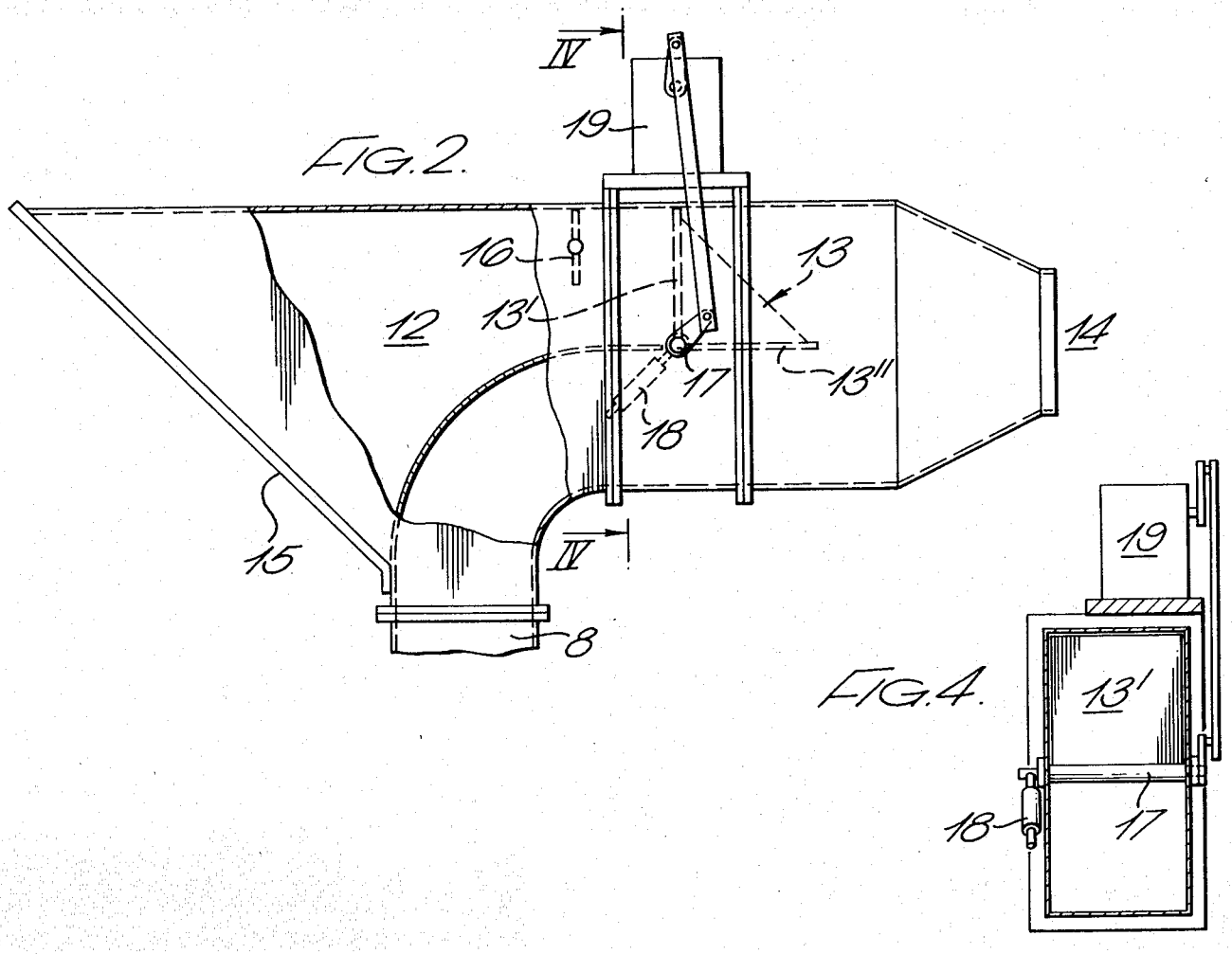
FIG. 2 is a more detailed side elevation of part of the installation of FIG. 1.
FIGS. 4 and 5 are sections through FIGS. 2 and 3 taken on lines IV—IV and V—V respectively.

Referring to FIG. 1 there is shown an air exhaust installation according to the present invention. The installation is accommodated in a building having a roof 1, floor 2, and a service void 3. In a laboratory within the building there is a fume cupboard 4 having the generally conventional design features of a vertically sliding sash window 5 giving access to the interior of the fume cupboard and an exhaust duct 6 conected to the interior through a rear mounted scrubber unit 7. The internal parts of the fume cupboard are shown in broken lines in FIG. 1. The exhaust duct 6 connects to a vertical duct 8 disposed in the service void 3 which leads to the roof 1 of the building. On the roof the vertical duct 8 is joined to a section of ducting 14 which connects to a chimney 9. At the base of the chimney 9 is a suction fan 11 which draws air along the section of ducting 14 and drives it up the chimney to a cowl 10 which is shaped to discharge the air at a high velocity into the atmosphere.

In order to satisfy safety requirements a minimum volume of air per second must be driven up the chimney by the fan so that the velocity of the air discharged is high enough to disperse the dangerous fumes and gases extracted from the fume cupboard.

At the junction of the vertical duct 8 with the section of ducting 14 on the roof there is a bypass arrangement having a bypass air inlet 12 parallel to an extension of the duct 8 and terminating in an internal adjustable baffle 13. As shown more clearly in FIGS. 2 to 5, where internal parts are shown by broken lines, the air inlet 12 effectively forms an extension of the section of ducting 14 with its open end angled downwards and covered with a grill 15. A rotatable manually preset damper 16 is positioned in the air inlet 12 so as to enable its effective area to be adjusted.

The internal baffle 13 comprises a pair of baffle blades spanning the inside of the ducting and mounted at right angles to one another on a spindle 17 which is journalled in the middle of the side walls of the ducting. When the baffle is in the position shown in FIGS. 2 to 5 the upper baffle blade 13' substantially blocks off the air inlet 12 from the section of ducting 14 so that substantially all the air passing through the suction fan 11 is drawn from the vertical duct 8. Rotation of the baffle on its spindle gradually opens up the air inlet 12 to the suction of the fan 11 as the lower baffle blade 13'' closes off the vertical duct 8 until, when rotated through 90°, substantially all the air passing through the suction fan is drawn from the bypass air inlet. Other baffle designs may provide similar control of the air flow in other forms of bypass arrangements. By suitably setting the damper 16 the volume of air drawn by the suction fan can be made substantially constant as the baffle rotates. This ensures that the velocity of the air discharged at the chimney cowl 10 is maintained as the proportion of air drawn respectively from the vertical duct 8 and the air inlet 12 is varied by the baffle 13. The manual adjustment ability provided by the damper 16 is needed to allow for differences in air flow between installations.

The spindle 17 of the baffle 13 carries a crank arm linkage and a counterweight assembly 18 which balances the baffle blades 13' and 13''. In the embodiment shown in FIGS. 2 and 4 the linkage is driven by an electric servo motor 19, so that the position of the servo motor spindle determines the volume of air drawn from the vertical duct 8 per second. The servo motor is electrically connected to a control circuit 20 as shown in FIG. 7.

Referring to FIG. 7, the control circuit 20 comprises a mains transformer 21 whose primary is connected through a mains switch to the 240 volt A.C. mains supply. The secondary of the mains transformer is wound to give a low voltage supply of 24 volts A.C. and is connected to the supply terminals of the servo motor 19 (e.g. a Honeywell Modutrol 8Z50/60 or similar). Control signals for the servo motor are supplied from the ends of a rotary potentiometer 22 whose wiper is connected to one side of the low voltage supply. The position of the wiper thus determines the relative sizes of the control signals so that when applied to servo motor these allow the motor spindle to turn to a position determined by the position of the wiper on the potentiometer.

For a standard size fume cabinet the potentiometer 22 is a ten turn potentiometer mounted in the fume cabinet 4. In the fume cabinet the sash window 5 is attached by a 6 mm pitch chain to a counterweight so that the weight of the sash is balanced and raising and lowering it is made easy. The chain passes over a 14 tooth sprocket of approximately 2.5 cm diameter mounted on the shaft of the potentiometer 22 and an idler pulley between the sash and the counterweight. For other sizes of fume cupbroad the potentiometer and/or the sprocket may be varied so that in each case movement of the sash from fully closed to fully open moves the wiper from one end of the potentiometer to the other and intermediate positions of the sash give corresponding intermediate positions of the wiper. The position of the sash thus determines the position of the baffle 13.

In setting up the installation, the damper 16 is first adjusted to give a substantially constant volume of air through the suction fan throughout the range of movement of the baffle 13 and a manual damper 23 in the soffit of the fume cupboard is then adjusted to give the required velocity of air flow when the sash is fully open. The servo motor linkage between the sash and the baffle then ensures that as the sash is closed the baffle moves to reduce the volume of air drawn from the laboratory at a rate which maintains the required velocity of air flow through the smaller area of the opening, while extra air is drawn in at the air inlet to maintain the velocity of the air discharge at the chimney. It has been found by experiments that on high risk highly toxic fume cupboard applications, a total turndown with the sash in a closed position is necessary to evacuate the chamber of any fumes and vapours and also to eliminate the possibility of condensation of gases or vapours within the chamber and associated duct systems. In this case, a volumetric flow rate to abour 25% or original total exhaust volumetric flow rate with the sash in fully open position is required. With lower risk fume cupboard applications, this turndown ratio can be reduced to a 10% of the total volumetric capacity with the sash in fully open position. The servo motor linkage is adjusted appropriately to prevent complete closure of the duct 8 when the sash is closed.

Figure 6:
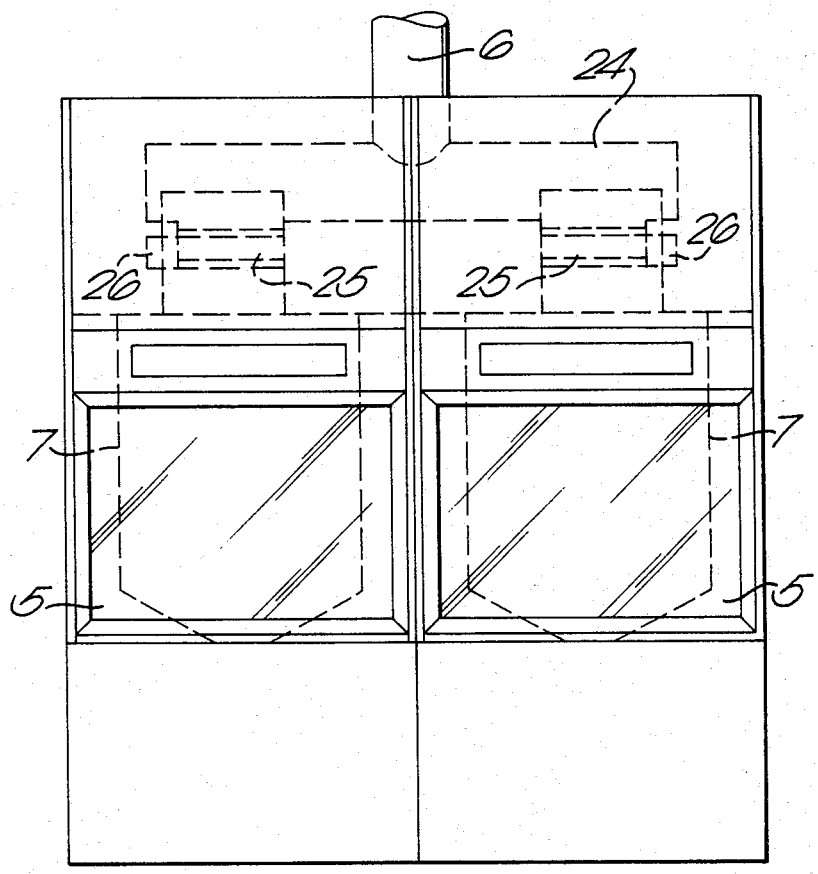
FIG. 6 is a front elevation of a pair of fume cupboards which can be optionally used in the installation of FIG. 1.

The system may also be used in installation where more than one fume cupboard is connected to the vertical duct 8 and where the minimum velocity of air flow must be maintained in each fume cupboard whatever the positions of the different sashes on the fume cupboards. A typical pair of fume cupboards is shown in FIG. 6 where internal parts are shown in broken lines, each fume cupboard having a sash window 5 and rear mounted scrubber unit 7 as in the fume cupboard of FIG. 1, the scrubber unit 7 connecting to an exhaust duct 6 via a manifold 24. A similar manifold arrangement would be used for 3 or more fume cupboards. With more than one fume cupboard connected to a common exhaust duct via a manifold it is necessary to balance the air flow through the respective cupboards since there is a tendency for air to take the path of least resistance. This balancing of the air flow is achieved by fitting an automatic soffit damper into each fume cupboard. The soffit dampers in FIG. 6 are fitted between the scrubber units and the manifold and each comprise a baffle 25 rotatable by a servo motor 26 between a position where it substantially closes the air passage and a position where the air passage is substantially open.

The control circuit for an installation of two fume cupboards with servo controlled soffit dampers is shown in FIG. 8 and comprises the basic circuit 20 connected to the servo motor 19 on the roof with further circuit elements 27 ad 28. Circuit element 27 is connected to one of the servo motors 26 and comprises a rotary potentiometer 29 arranged in the same manner as the potentiometer 22 in FIG. 7 so that the positon of the wiper on the potentiometer 29 determines the position of the first soffit damper. Circuit element 28 has a rotary potentiometer 30 which is connected to the other servo motor 26 also in the same manner as the potentiometer 22 in FIG. 7 so that the position of the wiper on the potentiometer 30 determines the position of the second soffit damper. The circuit element 28 also has a rotary potentiometer 22' which is connected in series with the potentiometer 22 in the circuit 20 so that positions of the wipers on both potentiometers 22 and 22' determine the position of the baffle 13.

The potentiometers 22 and 29 are multi-turn potentiometers mounted in the first fume cupboard with a sprocket as described above on the shaft of each potentiometer and the chain connecting the sash and counterweight passing over both sprockets, so that the position of the sash determines the positon of its soffit damper, the damper opening as the sash is raised, and contributes to the position of the baffle 13. The potentiometers 22' and 30 are multi-turn potentiometers similarly mounted in the second fume cupboard so that the position of the sash determines the position of its soffit damper in the same way and also contributes to the position of the baffle 13.

Thus the circuit of FIG. 8 ensures that the total volume of air drawn from both fume cupboards is determined by the amount both sashes are open, and also balances the air flows through the two fume cupboards so that movement of the sash on one does not adversely affect the air flow through the other.

Figure 9:
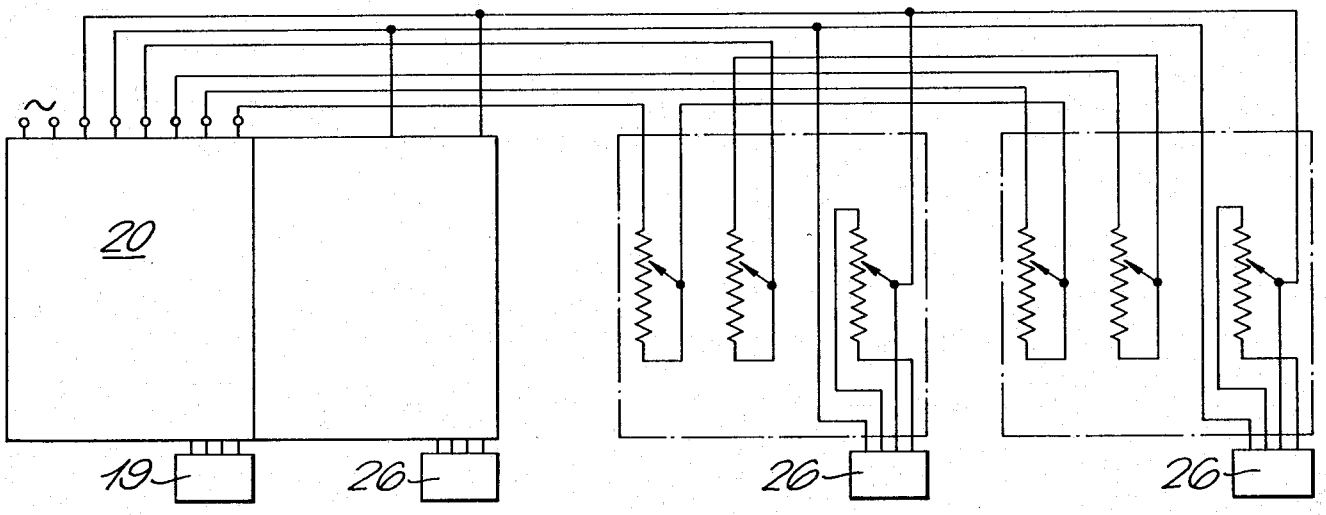
FIG. 9 is a modification of the wiring diagrams of FIG. 7 for use with three fume cupboards.

The use of servo controlled soffit dampers may be extended to larger numbers of fume cupboards connected via a common manifold and FIG. 9 shows the circuit arrangement for three fume cupboards each having a servo motor 26 for its soffit damper. This operates similarly to FIG. 8, except that the second and third cupboards each have three rotary potentiometers driven by the sash chain, two of them being connected in series with the potentiometer 22 on opposite sides thereof.

Figures 3, 5:
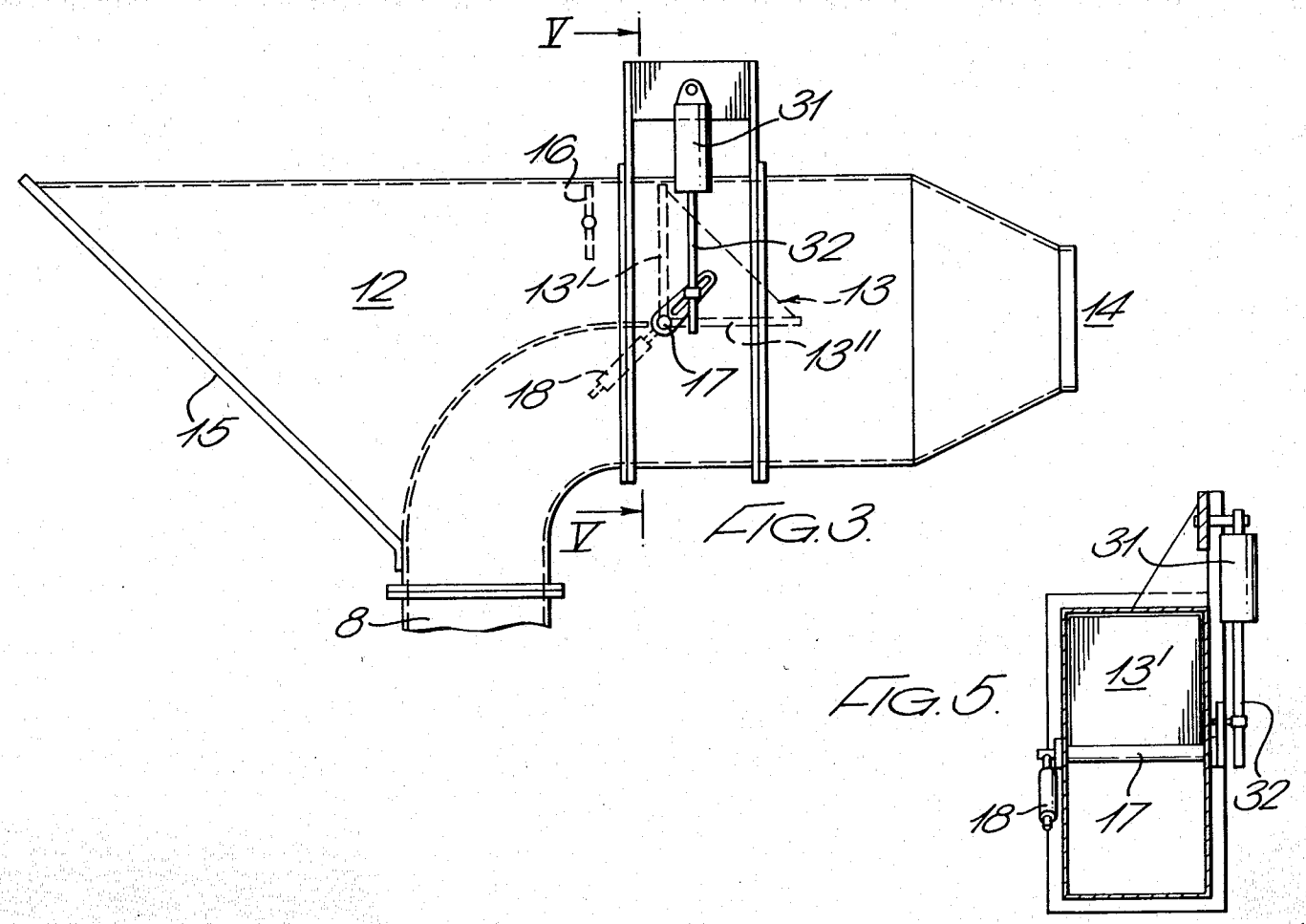
FIG. 3 is a side elevation corresponding to FIG. 2 but showing an alternative construction.

In situations where electrical control is not advisable such as when handling explosive gases and vapours, a pneumatic control system may be used. An embodiment using pneumatic control is shown in FIGS. 3 and 5 where the crank linkage of the spindle 17 is driven by an air cylinder 31 through a piston rod 32. The position of the piston determines the volume of air drawn from the vertical duct 8 per second and is controlled by a pneumatic control system equivalent to the electrical control system shown in FIGS. 7, 8 or 9. A rotary spindle variable pressure valve is used in place of the rotary potentiometer, being driven by the sash movement in the same way using a sprocket and chain. Details of the pneumatic control system are not given as these may be easily deduced from the electrical systems described above.

In particular, the servo controlled soffit dampers used when two or more fume cupboards are to be connected to the vertical duct 8 are simply replaced by soffit dampers whose baffles are controlled by air cylinders through crank arm linkages.

In all the above described embodiments the maximum loss of air from the laboratory occurs when the sash or sashes are fully open. In order to remind users of the energy loss when a sash is fully open for an extended period of time a microswitch may be fitted to the frame of the cupboard and connected via an adjustable timer to an alarm such as a flashing light or audible buzzer to that when the sash is lifted beyond a certain predetermined position the alarm is operated after a preset time, sufficient to allow periodic inspections and adjustments of experiments without sounding the alarm. A master key operated switch could be included in the alarm circuit to allow de-activation if it is imperative that the cupboard is left open for a long period.

An emergency override button may also be provided which when operated bypasses the sash position sensing arrangements and causes the baffle 13 and any soffit dampers to move immediately to the position in which the maximum volume of air is drawn from the fume cupboards. This will deal with emergencies such as large spillages of toxic or other dangerous materials.

During operation of the above described method and apparatus the volume of air taken from a laboratory per second will vary considerably and the air conditioning plant providing air for the laboratory may have difficulty coping with this variation. To deal with this a proportional signal may be taken from the control system, whether electrical or pneumatic, and be used to operate a damper or dampers in the air supply to the laboratory, so that the volume of air supplied is varied in dependence on the volume of air exhausted.

The above described system is particularly suitable for use with existing air exhaust installations since it simply involves a modification to the ducting on the roof and the fitting of sprocket driven potentiometers or valves to the fume cupboards with their associated control circuits.

No modifications are needed to the existing exhaust fan unit and the resistance to gas flow offered by the modified ducting is simply that of a conventional swept radius bend.

While the present invention has been described with respect to a fume cupboard installation it is also applicable to other air extract situations where a certain velocity of air flow is required across an aperture of variable size.

We claim:

1. Air extraction apparatus for extracting air from an enclosure situated solely within a room, said enclosure including an air inlet having a variable opening to provide air only from within said room, and an air outlet including a duct, a suction fan fluidly connected to said duct, and bypass means in said duct fluidly connected to said suction fan, said bypass means communicating with the environment outside said room to supply only atmospheric outside air directly to said fan, said bypass means including adjustable baffle means, said baffle means being pivotable between a first position in which it substantially closes off the suction side of the fan from the enclosure and a second position in which it substantially closes off the suction side of the fan from the outside atmosphere monitoring means for directly monitoring the extent of said variable opening, and control means responsive to said monitoring means for automatically adjusting said baffle means in a manner continuously proportional to the monitored extent of said opening, so that the volume of atmospheric bypass air increases as the volume of air entering the enclosure through said variable opening from said room decreases, and vice versa, such that a predetermined velocity of air is maintained through said variable opening and such that the velocity of air through said suction fan is maintained constant while the volume of air extracted from said enclosure is varied.

2. Apparatus according to claim 1 wherein said bypass means transversely divides said duct into a first duct portion directly connected to the enclosure and a second duct portion directly connected to the outside atmosphere, said duct portions meeting at a junction, and said baffle means comprises two baffle blades connected to one another along a pivot axis at the junction of the duct portions, whereby each blade controls the air flow in one of the duct portions.

3. Apparatus as claimed in claim 1 wherein said control means comprises an electrical servomotor and wherein the angular position of the baffle means is determined by an electrical control circuit.

4. Apparatus as claimed in claim 1 wherein said control means comprises a crank linkage connected to a pneumatic cylinder and wherein the linear position of the baffle is determined by a pneumatic control circuit.

5. Apparatus according to claim 1 including manually adjustable damper elements in the ducting for balancing the flow of air from the enclosure and from the outside atmosphere.

6. Apparatus according to claim 1 including an alarm, switch means connected to said alarm, said switch means being responsive to the area of the opening to activate the alarm when the area of the opening is greater than a predetermined value.

* * * * *